US007187898B2

(12) United States Patent
Katayanagi et al.

(10) Patent No.: US 7,187,898 B2
(45) Date of Patent: Mar. 6, 2007

(54) IMAGE FORMING APPARATUS HAVING A FIXING DEVICE FOR FIXING TONER INCLUDING WAX ON A TRANSFER SHEET

(75) Inventors: Hidetoshi Katayanagi, Tokyo (JP); Masami Maruko, Hachioji (JP); Hajime Tanaka, Hachioji (JP); Kazunori Katada, Hino (JP); Masashi Saito, Hino (JP); Toshiki Hayami, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 184 days.

(21) Appl. No.: 10/873,788

(22) Filed: Jun. 22, 2004

(65) Prior Publication Data

US 2005/0019069 A1 Jan. 27, 2005

(30) Foreign Application Priority Data

Jul. 25, 2003 (JP) ..... 2003-201471

(51) Int. Cl.
*G03G 15/20* (2006.01)

(52) U.S. Cl. ..... 399/327

(58) Field of Classification Search ..... 399/327, 399/324, 325

See application file for complete search history.

(56) References Cited

U.S. PATENT DOCUMENTS

| | | | | | |
|---|---|---|---|---|---|
| 4,949,130 | A | * | 8/1990 | Torino | 399/327 |
| 5,678,153 | A | * | 10/1997 | Okamoto et al. | 399/327 |
| 5,749,038 | A | * | 5/1998 | Fromm et al. | 399/327 |
| 5,937,255 | A | * | 8/1999 | Kagawa | 399/324 |
| 6,091,923 | A | * | 7/2000 | Yamamuro | 399/324 |
| 6,334,041 | B1 | * | 12/2001 | Oota | 399/327 |

FOREIGN PATENT DOCUMENTS

| | | | |
|---|---|---|---|
| JP | 08272256 | A * | 10/1996 |
| JP | 2001215837 | A * | 8/2001 |
| JP | 2002189375 | A * | 7/2002 |

* cited by examiner

*Primary Examiner*—Susan Lee
(74) *Attorney, Agent, or Firm*—Cantor Colburn LLP

(57) ABSTRACT

An image forming apparatus having a fixing device for fixing toner including wax on a transfer sheet including a fixing rotating member for fixing toner on the transfer sheet with a rotation thereof, and first cleaning member contacting to the fixing rotating member so as to remove melted wax on the fixing rotating member. A surface roughness Rz of the first cleaning member is not more than 1.6 μm.

14 Claims, 5 Drawing Sheets

IMAGE FORMING APPARATUS HAVING A FIXING DEVICE FOR FIXING TONER INCLUDING WAX ON A TRANSFER SHEET

BACKGROUND OF THE INVENTION

The present invention relates to an image forming apparatus having an electro-photographic or electrostatic recording type fixing device.

Normally, on a fixing device used for an electro-photographic image forming apparatus, a fixing nip is formed, for example, by fixing roller and pressing roller and a transfer material carrying toner thereon is fixed on this fixing nip.

Conventionally, during this fixing process, offset of toner in which toner sticks onto the fixing roller surface is caused or winding of paper in which a sheet carrying toner thereon is rolled up around the fixing roller is caused. Although the above has resulted in a problem that the image quality and paper feeding performance are deteriorated, a technique of applying, for example, silicone oil on the fixing roller surface has been employed for preventing the offset and paper winding. In the Japanese Patent Application Laid-Open Publication No. 11-7216, for example, a fixing device using oil is disclosed.

With a conventional technique of using silicone oil on the fixing roller, however, silicone oil on the fixing roller adheres onto the transfer sheet and so sticky touch due to the silicone oil adhesion cannot be avoided and the quality of the image produced is questionable. In addition, silicone oil is expensive and also it becomes necessary to install a mechanism for supplying silicone oil to the fixing device on the apparatus. Moreover, part of silicone oil evaporates due to heat and may contaminate inside of the apparatus.

In view of the above, a technique that, by reducing the conventional use of silicone oil on the fixing roller as much as possible and instead by using wax-added toner, wax melted out from the toner by heat is supplied to the fixing roller and that the offset and paper winding is prevented is disclosed in the Japanese Patent Application Laid-Open Publication No. 2001-125414 and HEI 3-185459 (1991).

Use of wax-added toner as above enables to reduce the use of silicone oil and prevent the offset and paper winding.

When wax-added toner is used, however, part of wax infiltrates out from the toner onto the fixing roller adheres to the fixing roller and a latent image caused by wax is formed on the fixing roller. If the next fixing step is carried out under the above condition, the wax forming a latent image is fixed on the image surface thereafter. It is found that, as a result of the above, wax is distributed abnormally on the image surface and that a phenomenon of uneven gloss or uneven transmission in the case of OHT (hereinafter called gloss memory) is caused. The gloss memory is very remarkable on a uniform plain image and degrades the image quality as it generates uneven gloss or uneven transmission due to the wax latent image on transfer sheet or OHT. This becomes particularly remarkable on a color image of which the above plain image occupies wider area, resulting in deteriorated image quality.

The afore-mentioned Japanese Patent Application 11-7216 describes a procedure of toner cleaning for removing the residual toner on the fixing roller, using an external heating roller and web, but does not mention about toner including wax nor about the above phenomenon caused by the wax. This document contains a description that specifies the surface roughness of the external heating roll (average surface roughness of not more than 0.07 mm), but an image forming apparatus like this cannot resolve the phenomenon involved in an image forming apparatus that uses toner including wax.

SUMMARY OF THE INVENTION

The present invention is made in view of the above problems and constructed as follows:

(1) An image forming apparatus having a fixing device for fixing toner including wax on a transfer sheet comprising fixing rotating member for fixing toner on the transfer sheet with a rotation thereof, and first cleaning member contacting to said fixing rotating member so as to remove melted wax on said fixing rotating member, wherein a surface roughness Rz of said first cleaning member is not more than 1.6 μm; or (2) An image forming apparatus having a fixing device for fixing toner including wax on a transfer sheet comprising fixing rotating member for fixing toner on the transfer sheet with a rotation thereof, and first cleaning member contacting to said fixing rotating member so as to remove melted wax on said fixing rotating member; or (3) A fixing device for fixing toner including wax on a transfer sheet comprising fixing rotating member for fixing toner on the transfer sheet with a rotation thereof, and first cleaning member contacting to said fixing rotating member for removing melted wax on said fixing rotating member, wherein a surface roughness Rz of said first cleaning member is not more than 1.6 μm.

DETAILED DESCRIPTION OF THE PREFERRED EMBODIMENT

Embodiments of the present invention are described hereunder, using figures, but the invention is not limited thereto. In addition, although the description below may contain definitive expressions on terms and others, it simply describes preferred embodiments of the invention and in no way limits the definition of terms or technical scope of the invention.

Figure 1:
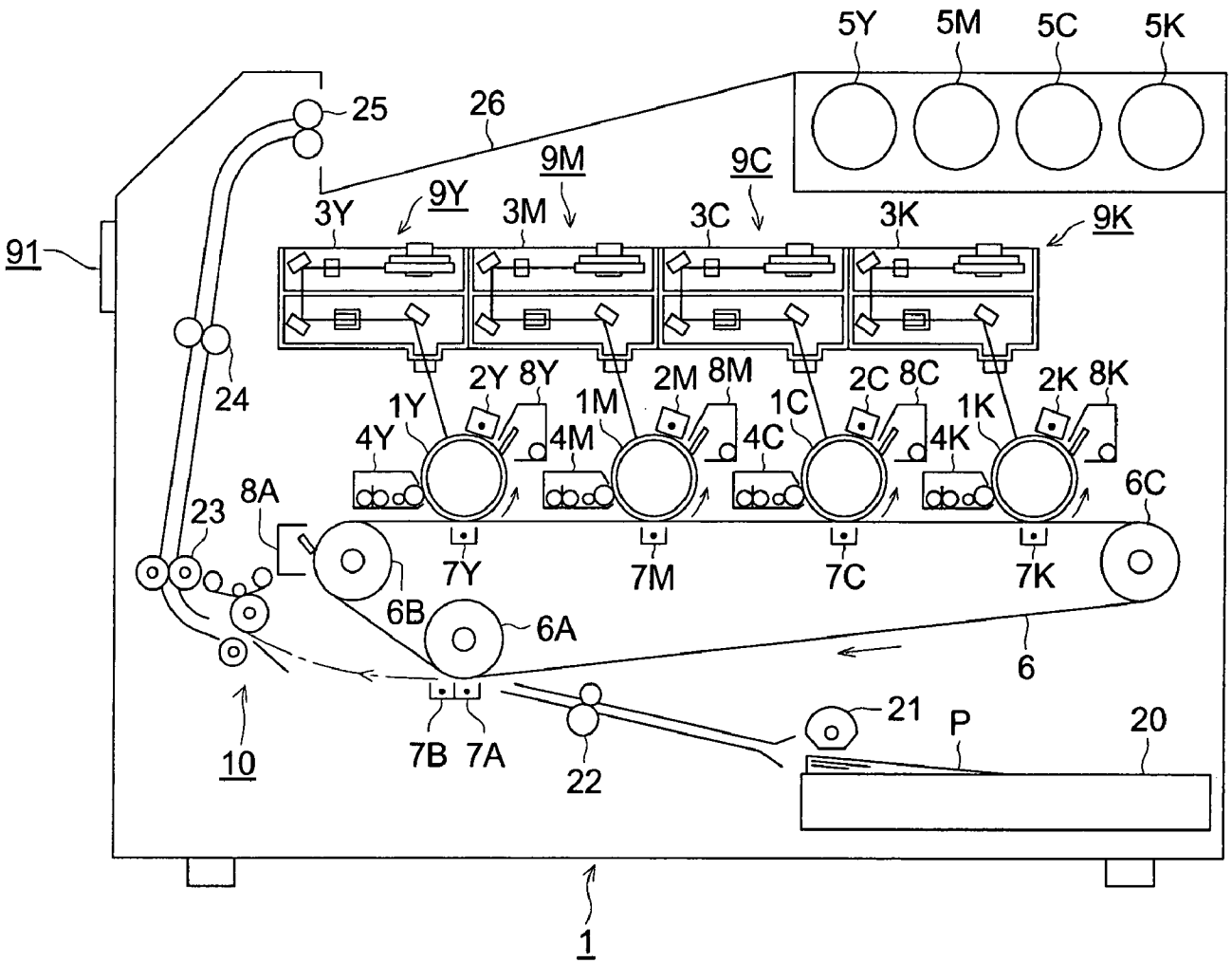
FIG. 1 is a schematic diagram of an image forming apparatus of the present invention.

FIG. 1 is a schematic diagram of an image forming apparatus of the present invention.

As shown in FIG. 1, the image forming apparatus is called a tandem type color image forming apparatus that comprises multiple image forming units 9Y, 9M, 9C and 9K, belt-shaped intermediate transfer member 6, paper feeder, conveying means, toner cartridges 5Y, 5M, 5C and 5K, fixing device 10 according to the present invention, and operating unit 91.

The image forming unit 9Y for forming yellow image comprises charging means 2Y, exposing means 3Y, developing means 4Y, transferring means 7Y and cleaning means 8Y, which all are arranged around an image retaining member (hereinafter called photosensitive member) 1Y.

The image forming unit 9M for forming magenta image comprises photosensitive member 1M, charging means 2M, exposing means 3M, developing means 4M, transferring means 7M and cleaning means 8M.

The image forming unit 9C for forming cyan image comprises photosensitive member 1C, charging means 2C, exposing means 3C, developing means 4C, transferring means 7C and cleaning means 8C.

The image forming unit 9K for forming black image comprises photosensitive member 1K, charging means 2K, exposing means 3K, developing means 4K, transferring means 7K and cleaning means 8K.

Intermediate transfer member 6 is so held as to be able to rotate around multiple rollers 6A, 6B and 6C.

Image of each color formed by the image forming unit 9Y, 9M, 9C and 9K is transferred primarily onto the rotating intermediate transfer member by the transferring means 7Y, 7M, 7C and 7K one after another and a composite color image is formed.

Sheet P stored in a paper cassette 20 as paper feeder is fed one after another by a paper feeding roller 21 and conveyed through a resist roller 22 to the transferring means 7A, and the color image is transferred secondarily on the sheet P.

The sheet P on which the color image has been transferred is subjected to a fixing process through the fixing device 10, which is a fixing device of the present invention, conveyed through conveying roller 23 and 24 as conveying means, ejected through a ejecting roller 25, and piled on an eject paper tray 26 outside the apparatus.

Figure 2:
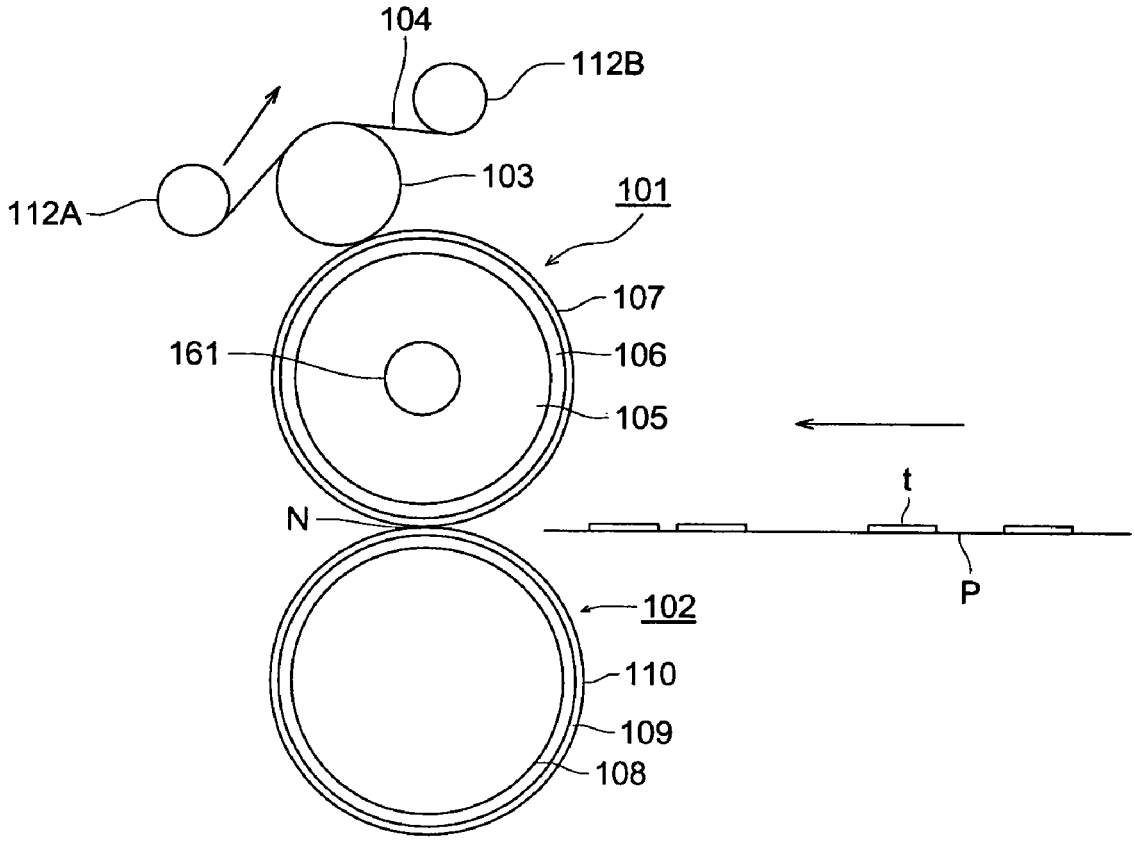
FIG. 2 is a brief cross-sectional view for explaining an embodiment of an image forming apparatus of the present invention.

FIG. 2 is a brief cross-sectional view of the fixing device 10 for explaining a fixing device of the present invention in detail.

As shown in FIG. 2, the fixing device 10 as fixing device of the present invention has a heating fixing roller 101 as fixing rotating member of the invention. The fixing device is also equipped with a cleaning roller 103 as first cleaning member of the invention and cleaning web 104 as second cleaning member of the invention, and they remove wax adhered on the heating fixing roller 101.

The heating fixing roller 101 is pressing rotating member. A pressing roller 102 contacts with pressure to the heating fixing roller 101 so as to form a fixing nip N, and heat fixing is performed as the transfer material P carrying toner image t thereon is passed through the fixing nip N. As a result of the heat fixing at the nip N, toner image t is melted and fixed on the transfer material P. In this process, because the wax dispersed and contained in toner image t is melted and a specified volume or more comes to stay on the interface between the heating fixing roller 101 and melted toner resin, adhesion force between the toner resin and heating fixing roller 101 decreases and so the offset or winding of the transfer material is reduced and part of the wax adheres onto the heating fixing roller 101.

The heating fixing roller 101 is made of an aluminum cylindrical core 105 containing halogen heater 161 as heat source, around which a heat resisting elastic layer 106 of silicone rubber of 1.5 mm thick is formed and additional one to three adhesion layers are formed over it, and then a toner releasing layer 107 of PFA resin of 30 μm thick is formed on the top surface by applying dispersed PFA resin and baking, and it is rotated by a motor, not shown. It is also permissible to cover the heating fixing roller 101 with a PFA tube made in a tube shape over the heat resisting elastic layer 106 with some adhesion layers between them.

The pressing roller 102 is made of an aluminum cylindrical core 108 around which a heat resisting elastic layer 109 of silicone rubber of 1.0 mm thick is formed and additional one to three adhesion layers are formed over it, and then a toner releasing layer of PFA resin of 30 μm thick is formed on the top surface, and rotates in following up the pressing roller 102 while contacting with pressure to the transfer sheet P carrying toner image t thereon. The toner releasing layer 110 is formed in the same manner as for the afore-mentioned toner releasing layer 107.

It is preferable to use material containing fluorine contained resin for the toner releasing layer 107. More preferable fluorine contained resin is material containing any one of PFA, PTFE and FEP and the most preferable is any one of PFA, PTFE and FEP. By using this, releasing performance of the surface of the heating fixing roller 101 with regard to wax contained in the toner resin or toner particles improves, toner comes not to adhere easily on the surface of the heating fixing roller 101 in the fixing process, and wax comes not to adhere easily on the surface of the heating fixing roller 101. Accordingly, even if some wax may adhere on the surface of the heating fixing roller 101, wax removal effect of the cleaning roller 103 can further improve and so the gloss memory can be further reduced.

It is preferable that the thickness of the toner releasing layer of the heating fixing roller 101 is 20 to 50 μm. With a thickness of not less than 20 μm, uniform fluorine contained resin layer can be formed easily. With a thickness of not more than 50 μm, the surface of the heating fixing roller 101 can easily copy the uneven surface of the transfer sheet P containing toner image t thereon, and so degradation of the image can be prevented. In addition, because the surface of the heating fixing roller 101 can easily copy the surface of the cleaning roller 103 in a region not more than 50 μm, the wax removal effect of the cleaning roller 103 can further improve.

The cleaning roller 103 is made of an aluminum cylindrical core on which alumina film is formed by hard anodizing, which is then subjected to secondary electrolysis in ammonium tetra-thiomolybdate solution so as to deposit molybdenum disulfide in fine pores in the film, and finally the surface is polished. The surface roughness Rz is not more than 1.6 μm and Vickers surface hardness is not less than 350 $kg/mm^2$. It is possible to install a halogen heater inside the aluminum cylinder of this cleaning roller 103 so as to function also as an external heating roller.

As the material used for the cleaning roller 103 portion contacting to the heating fixing roller 101 can be any so far as it has the surface roughness Rz of not more than 1.6 μm and is heat-resistive to the surface temperature of the heating fixing roller 101. Instead of the above, it is also permissible to use an aluminum cylindrical core covered with a foamed silicone rubber layer of 3 to 8 mm thick molded to Asker-C (500 gf load) hardness of 15° to 50°, which is then covered with molded polyimide seamless tube having a thickness of about 50 to 80 μm and surface roughness of not more than 1.6 μm with some adhesion layers between them.

In this embodiment, the surface roughness Rz means the one at the reference length of 0.8 mm as specified in JIS B0601-1982. In other words, it is the difference between the average height of the top five crests and the average depth of the top five bottoms in the reference length of 0.8 mm.

It is particularly preferable that the surface roughness Rz of the cleaning roller 103 is not more than 1.0 μm. When the temperature on the heating fixing roller 101 is kept higher than the melting point of wax, wax stays in liquid phase normally having an approximate height of not more than 1

μm. Accordingly, by lessening the surface Rz to a small value as above, the contact of wax to the cleaning roller 103 is further ensured and so wax adhered on the heating fixing roller 101 can be wiped off more efficiently.

The cleaning roller 103 contacts to the heating fixing roller 101 at a load of 2 to 10 kgf, and the temperature at this contact area is kept higher than the melting point of wax contained in the toner by adjusting the halogen heater 161. Thus, wax adhered on the heating fixing roller 101 can be wiped off by the cleaning roller 103 while it is in a melted state, and so the wax removal efficiency from the heating fixing roller 101 improves and the gloss memory can be reduced.

The contact area between the cleaning roller 103 and heating fixing roller 101 shall preferably be wider than the maximum sheet width of the transfer material P used for image forming. The contact area between the cleaning web 104 and cleaning roller 103 shall also preferably be wider than the maximum sheet width of the transfer material P used for image forming. (These comparison of width are explained in a direction transverse to a sheet conveyance direction, that is corresponding to a direction of axis of the cleaning roller 103.) With this width, gloss memory can be eliminated from any size of the sheet.

The cleaning roller 103 also contacts to the cleaning web 104 and the temperature at the contact area between the cleaning roller 103 and cleaning web 104 is kept higher than the melting point of wax contained in toner by the heat from the heating fixing roller 101 heated by the halogen heater 161. With this construction, the wax that is adhered on the cleaning roller 103 as a result of wiping off the wax adhered on the heating fixing roller 101 can be wiped off by the cleaning web 104 in a melted state, and hence the wax removal efficiency from the cleaning roller 103 can improve. Since the melting point of wax contained in the toner is normally as low as not more than 110° C. or so, and since the heating fixing roller 101 always receives heat from the halogen heater 161 and so the surface temperature is normally kept at about not less than 160° C. and, besides, the heating fixing roller 101 and cleaning roller 103 contact to each other and rotates together, the temperature at the contact area between the cleaning roller 103 and cleaning web 104 is kept higher than the melting point of wax.

On a cleaning roller 103 made of aluminum cylindrical core on which aluminum film is formed and polished, for example, the surface temperature quickly increases as it contacts to the heating fixing roller 101 because of its excellent thermal conductivity. The wall thickness of the aluminum cylindrical core shall preferably be as thin as possible so far as no deflection is caused because the surface temperature can increase quickly. It shall preferably be about 0.8 to 2.0 mm. Even in the case of a cleaning roller 103 which is covered with foamed silicone rubber and then coated with polyimide tube, the surface temperature quickly increases as it contacts to and rotates with the heating fixing roller 101 because the thermal conductivity of the foamed silicone rubber is low.

It is preferred that a length of rotating time is allowed for the heating fixing roller 101 and cleaning roller 103 during warm-up. With this construction, the cleaning roller 103 can be heated to a high temperature immediately after starting up the image forming apparatus.

Given that the contact angle of the surface of the cleaning roller 103 contacting to the heating fixing roller 101 with regard to the wax contained in toner at a specified temperature T (° C.) in a range not less than the melting point but not more than 230° C. is A and that the contact angle of the surface of the heating fixing roller 101 contacting to the cleaning roller 103 with regard to the wax contained in toner at the specified temperature is B (°), it is preferred that A<B applies. With this construction, at the contact area between the heating fixing roller 101 and cleaning roller 103, the wax adhered on the heating fixing roller 101 and heated higher than the melting point can easily be moved from the heating fixing roller 101 to the cleaning roller 103, and accordingly the wax removal efficiency from the heating fixing roller 101 further improves and the gloss memory can further be reduced. The temperature range where the above-mentioned inequality of the contact angle must be kept is not less than the melting point of the wax and not more than the maximum temperature of the fixing rotating member surface under normal operating condition (the temperature at which fluorine contained resin on the fixing rotating member surface remains sufficiently durable).

In this invention, it is preferred that the thickness of the heat-resisting elastic layer 106 of the heating fixing roller 101 is not less than 0.2 mm, the Vickers surface hardness of the contact area between the cleaning roller 103 and heating fixing roller 101 is 350 kg/mm$^2$, and that the cleaning roller 103 contacts with pressure to the heating fixing roller 101 at a load of 2 to 10 kgf. By making the thickness of the heat-resisting layer 106 of the heating fixing roller 101 to not less than 0.2 mm, the heating fixing roller surface can easily copy the uneven surface of the transfer sheet P containing toner image t thereon, and so the image quality improves. In addition, even if the cleaning roller 103 is made of hard material, contact between the cleaning roller 103 and heating fixing roller 101 becomes stable, and accordingly the wax adhered on the heating fixing roller 101 can easily move from the heating fixing roller 101 to the cleaning roller 103 at the contact area between the heating fixing roller 101 and cleaning roller 103. Thus, the wax removal efficiency from the heating fixing roller 101 further improves and the gloss memory can further be reduced.

By making the Vickers surface hardness to not less than 350 kg/mm$^2$, generation of abrasion particles or change of the surface roughness of the cleaning roller 103 to worse, which is caused by abrasion of the cleaning roller 103 by the cleaning web 104 contacting to the cleaning roller 103 or by paper particles adhering on the cleaning roller 103, can be prevented, and so the cleaning effect of the cleaning roller 103 can be maintained.

Since the cleaning roller 103 contacts with pressure to the heating fixing roller 101 at a load of 2 to 10 kgf, contact between the cleaning roller 103 and heating fixing roller 101 becomes stable, the cleaning roller 103 can stably follow the rotation of the heating fixing roller 101 even though the cleaning web 104 contacts to it, and no damage is given to the heat-resisting elastic layer of the heating fixing roller 101.

Vickers surface hardness shall be a hardness measured according to JIS Z2251 Fine Hardness Test Method. To be concrete, when a dent is caused on a test surface using a diamond indenter of equilateral quadrangle cone having a diagonal face-to-face angle of 136°, the above is measured as a quotient of the load F (kgf) divided by the surface area of the dent calculated from the diagonal length d (mm) of the dent. It is calculated as Surface hardness (Hv)=1.8544 F/d2 (where d is an average (mm) of the diagonal lengths of the dent). In this invention, the surface hardness is measured by MVK-H 100 (manufactured by Akashi Co., Ltd.) under an environment of 23° C. and 50% RH.

The cleaning web 104 is a sheet of non-woven fabric of 70 μm thick and 27 g/m$^2$ in unit weight made of aromatic polyamide fiber and polyester fiber mixed at a ratio of 6:4 by weight. For the cleaning web 104, it is also permissible to use non-woven fabric of 46 μm thick and 27 g/m$^2$ in unit weight made of aromatic polyamide fiber and polyester fiber mixed at a ratio of 4:6 by weight.

If cleaning web 104 is not used, wax accumulates on the cleaning roller 103 and offset toner and paper particles, although in a small quantity, accumulate on the heating fixing roller 101, and the wax cleaning capacity of the cleaning roller gradually lowers. By using the cleaning web 104, however, since toner, paper particles and wax adhered on the cleaning roller 103 can be wiped off efficiently, the cleaning effect can be maintained and improved.

Any material may be used for the cleaning web 104 so far as it can wipe off wax at a temperature higher than the melting point from the cleaning roller 103, but non-woven fabric containing at least one of aromatic polyamide fiber and polyester fiber is preferable in view of heat resistance.

The cleaning web 104 is stretched with tension between the supply side roll 112A and take-up side roll 112B, both of which are cleaning member moving means of the present invention and so arranged that the cleaning roller 103 contacts to the cleaning web 104. The cleaning web 104 is moved by rotating the shaft of the take-up side 112B of the cleaning web sheet by a specified angle by a drive motor (not shown). With this construction, part of the cleaning web stained as a result of cleaning the cleaning roller 103 is moved, and hence the cleaning roller 103 can be cleaned without accumulation of a lot of toner, paper particles and wax on the contact area between the cleaning web 104 and cleaning roller 103. Thus, generation of the gloss memory can further be eliminated.

It is preferable and efficient to set the movement length of the cleaning web 104 to a fixed value within a range from 0.02 to 0.05 mm/copy (A3-size sheet). By setting the length not less than 0.02 mm/copy, the cleaning roller 103 can be cleaned sufficiently. By setting the length not more than 0.05 mm/copy, the length of the cleaning web 104 needs not be unnecessarily long, which is preferable in view of installation space and operation cost.

If the driving time of the cleaning web drive motor is calculated from a formula as a function of the accumulated driving time of the cleaning web drive motor starting from the time of loading a new cleaning web 104, the movement length of the cleaning web 104 can be controlled to a fixed value.

Silicone oil is not applied to the heating fixing roller 101. With this construction, the image quality can further improve and cost reduction can be expected.

In addition, the cleaning web 104 is not soaked with silicone oil. With this construction, the image quality can further improve and cost reduction can be expected.

Figure 3:
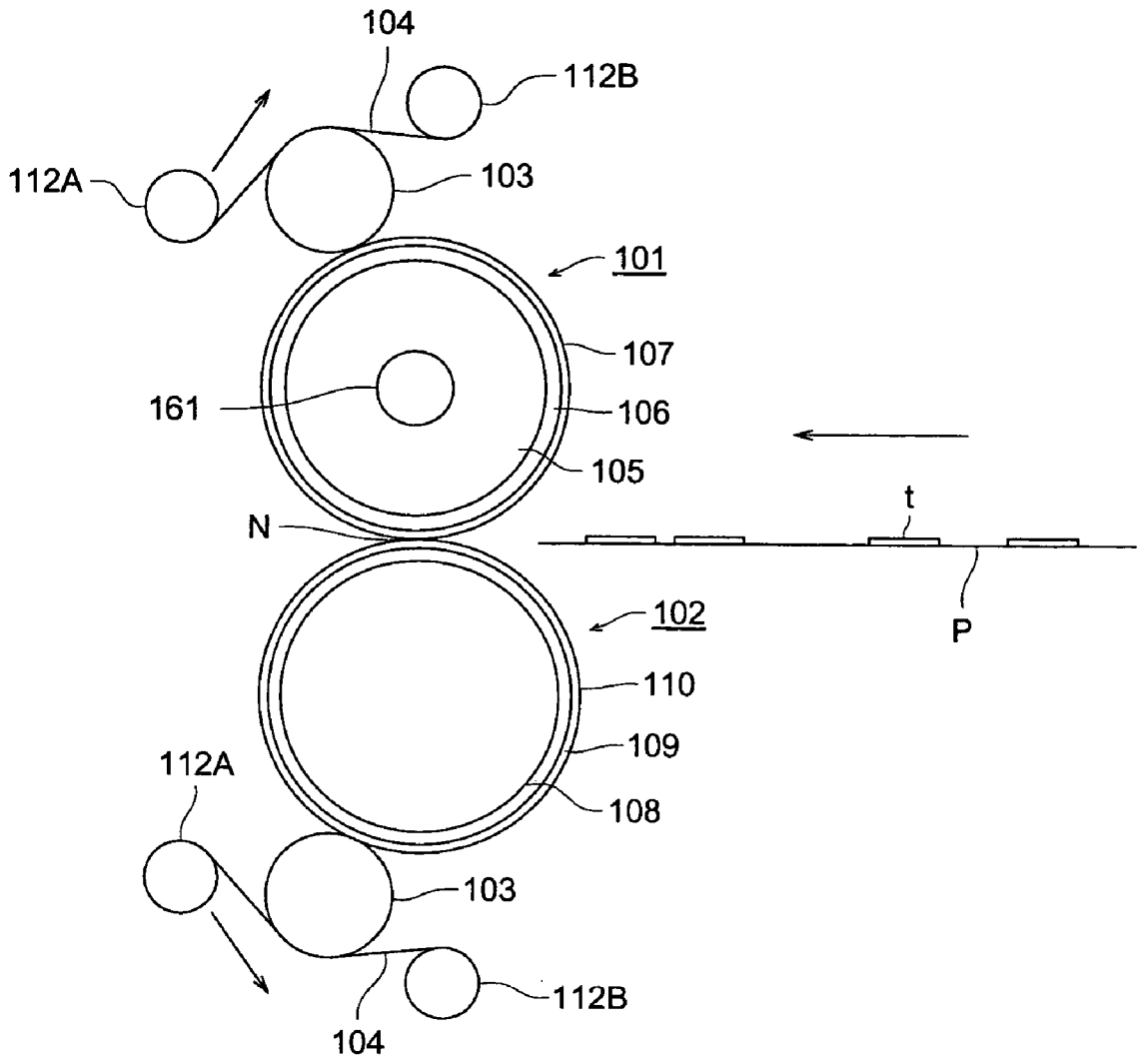
FIG. 3 is a brief cross-sectional view for explaining an embodiment of an image forming apparatus of the present invention.

Since wax infiltrated from the toner image t may contact to the pressing roller 103, it is permissible to arrange the cleaning roller 103 contacting to the pressing roller 102 and the cleaning web 104 contacting to the cleaning roller 103 as shown in FIG. 3 so as to remove wax from the pressing roller 102. In the description about FIG. 3 and thereafter, description of the components having the same terms already explained in FIG. 2 and other related description may be omitted. Unless otherwise described, they are the same as in FIG. 2.

Figure 4:
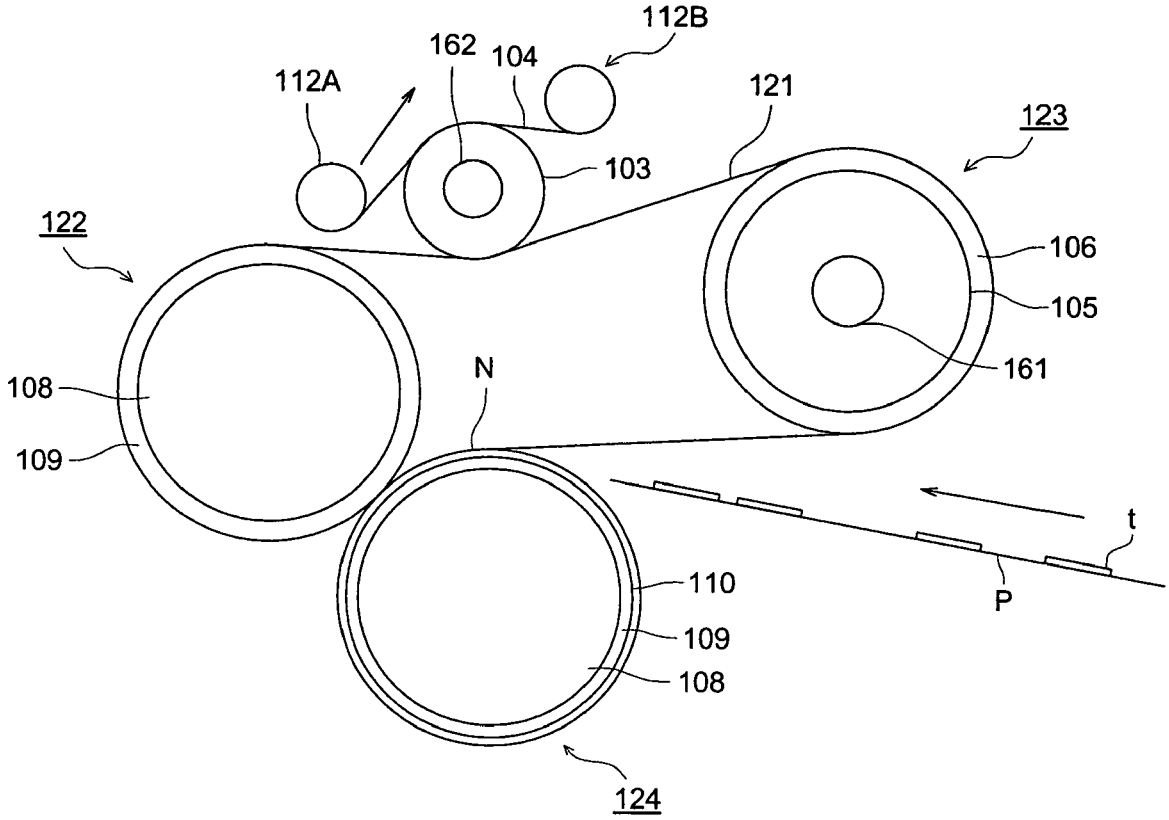
FIG. 4 is a brief cross-sectional view for explaining an embodiment of an image forming apparatus of the present invention.

Next, another embodiment of a fixing device of the present invention is shown in FIG. 4.

In the fixing device in FIG. 4, the fixing belt 121 as fixing rotating member of the invention is supported by the upper pressing roller 122 and supporting heating roller 123, and the supporting heating roller 123 is driven by a motor, not shown, to rotate the fixing belt 121. The fixing belt 121 is heated by the supporting heating roller 123.

In the fixing device in FIG. 4, the fixing belt 121 supported by the upper pressing roller 122 and supporting heating roller 123 and the lower pressing roller 124 form a fixing nip N, and heat fixing is performed as the transfer material P carrying toner image t thereon is passed through the fixing nip N.

In addition, the afore-mentioned cleaning roller 103 containing a halogen heater 162 inside is installed in contact to the fixing belt 121 and also the cleaning web 104 is installed in contact to the cleaning roller 103.

According to the present invention, even in the case that fixing rotating member of the invention is a fixing belt 121 as shown in FIG. 4, the temperature at the contact area between the fixing belt 121 and cleaning roller 103 and the temperature of the contact area between the cleaning roller 103 and cleaning web 104 are kept higher than the melting point of the wax contained in the toner in use, wax on the fixing belt 121 is wiped off by the cleaning roller 103 of which surface roughness is not more than 1.6 μm while it is in a melted state, and wax adhered on the cleaning roller 103 is wiped off by the cleaning web 104 while it is in a melted condition. With this construction, generation of the gloss memory can be eliminated.

In the fixing device in FIG. 4, the temperature at the contact area between the fixing belt 121 and cleaning roller 103 and the temperature of the contact area between the cleaning roller 103 and cleaning web 104 are adjusted to become higher than the melting point of wax, using the halogen heater 161 of the supporting heating roller 123 and halogen heater 162 of the cleaning roller 103. In the case where the cleaning roller 103 is located apart from the supporting heating roller 123 as shown in the figure, a halogen heater 103 is installed in the cleaning roller 103 as an additional heat source to heat the cleaning roller 103. With this construction, the temperature of each contact area can be controlled easily.

Figure 5:
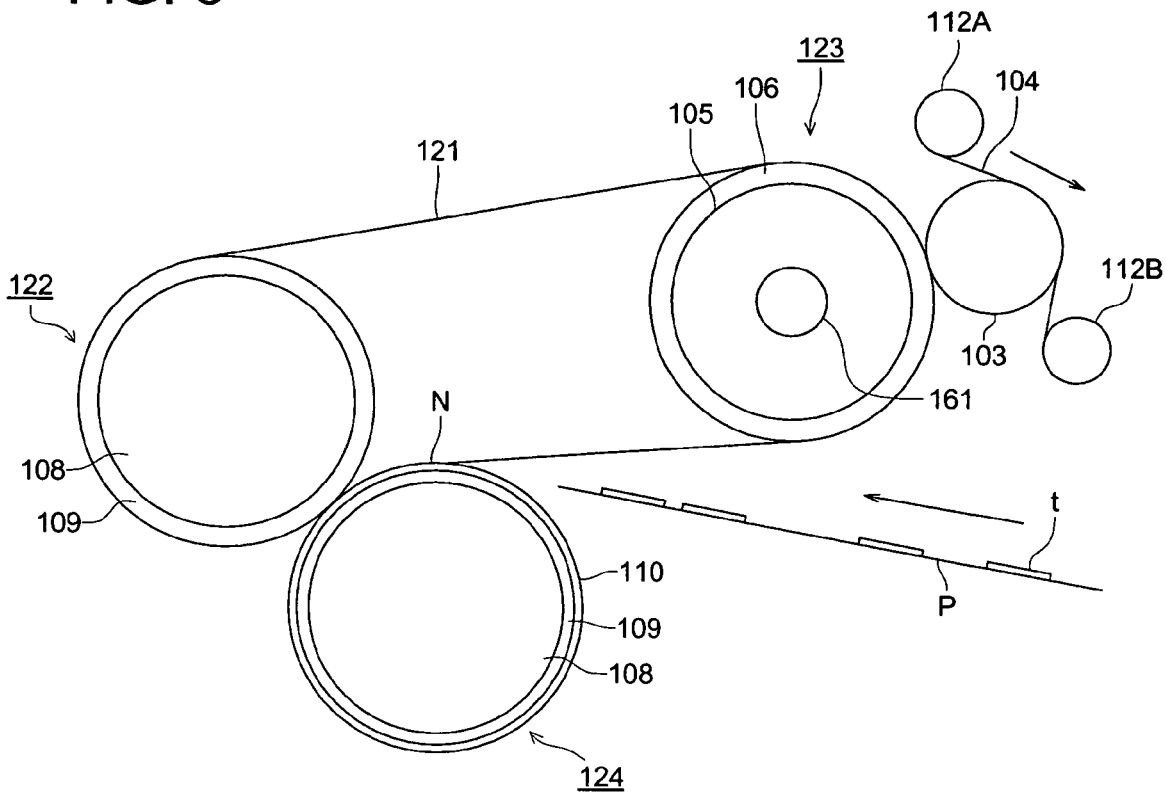
FIG. 5 is a brief cross-sectional view for explaining an embodiment of an image forming apparatus of the present invention.

If the device is so constructed that the cleaning roller 103 contacts to the supporting heating roller 123 with the fixing belt between them as shown in FIG. 5, the temperature at the contact area between the fixing belt 121 and cleaning roller 103 and the temperature of the contact area between the cleaning roller 103 and cleaning web 104 can be adjusted easily only by the halogen heater 161 of the supporting heating roller 123 to become higher than the melting point of wax. It, therefore, is not necessary to install a halogen heater 162 in the cleaning roller 103.

Toner used in this invention may be any existing and known toner so far as it contains wax.

In this invention, any existing and known wax such as, for example, paraffin wax, polyolefin wax, modified materials thereof (for example, oxide and graft polymerized materials), higher fatty acid, metallic salt thereof, amide wax, and ester wax may be used, but use of higher fatty acid ester wax, for example, is preferable. By using this, infiltration of wax from the toner image to the fixing nip becomes favorable and so generation of the offset and paper winding can be prevented. In addition, since wax removal at the cleaning roller 103 becomes favorable, the gloss memory can further be prevented.

Wax content of the toner of the present invention shall preferably be 7 to 23 weight %. With the wax content of not less than 7 weight %, wax infiltration from the toner image at the fixing nip becomes sufficient and so generation of the offset and paper winding can further be prevented. On the other hand, with the wax content of not more than 23 weight %, excessive wax adhesion onto the heating fixing roller 101 can further be prevented.

Polymerized toner can be mentioned as toner of which wax content can be adjusted easily. The toner used in the present invention shall preferably be polymerized toner because the wax content can easily be adjusted.

The melting point of the wax contained in the toner of the present invention shall preferably be 75 to 110° C. By using this, wax infiltration from the toner image at the fixing nip and wax melting at the contact area between the heating fixing roller 101 and cleaning roller 103 become smooth, generation of the offset and paper winding can be further prevented. In addition, since wax removal at the cleaning roller 103 becomes favorable, the gloss memory can further be prevented.

[Preferred Embodiment]

[Adjustment of Toner 1]

Toner for multi-color copying machine Konica 9331 of which wax content is adjusted to 7 to 23 weight % is used. This toner is polymer toner prepared by emulsion polymerization. The softening point of the toner is about 120° C. when the wax content is about 13 weight %, and wax contained in the toner is higher fatty acid ester wax of which melting point is about 80° C. In this explanation, softening point means the temperature measured by an elevated type flow tester. The melting point of wax means the highest endothermic peak temperature of the differential scanning calorimetry (DSC) found in the DSC curve at the time of temperature increase.

[Preparation of Samples 1 to 7]

Using the image forming apparatus shown in FIG. 1 and FIG. 2, using the cleaning roller shown in Table 1 as the cleaning roller 103, and also using the toner 1 prepared in the embodiment 1 and Konica color paper of 81.4 g/m$^2$ (A4 size), full-color image is formed so that the toner adhesion on the paper is about 0.4 to 0.5 mg/cm$^2$, wherein 101 sheets of color image samples are formed continuously under three standard levels of the transfer sheet P conveying speed and the first sheet of each is thrown away. Thus, total 300 sheets of samples are prepared.

The heating fixing roller 101 and pressing roller 102 of the fixing device 10 shown in FIG. 2 is made as follows.

Heating fixing roller 101: It is a cylindrical core of aluminum A5056 around which a heat resisting elastic layer 106 of silicone rubber of 1.5 mm thick having the thermal conductivity of 0.50 W/m.k and JIS-A hardness of 10° is formed and additional two adhesion layers are formed over it, and then a toner releasing layer 107 of PFA resin of 30 μm thick is formed on the top surface by applying dispersed PFA resin and baking, which is then subjected to surface smoothing treatment. The outside diameter is made to 65.0 mm. The surface roughness Rz is not more than 2.0 μm.

Pressing roller 102: It is a cylindrical core of aluminum A5056 around which a heat resisting elastic layer 106 of silicone rubber of 1.0 mm thick having the thermal conductivity of 0.50 W/m.k and JIS-A hardness of 10° is formed and additional two adhesion layers are formed over it, and then a toner releasing layer 107 of PFA resin of 30 μm thick is formed on the top surface by applying dispersed PFA resin and baking. The outside diameter is made to 55.0 mm. The surface roughness Rz is not more than 2.0 μm.

The compression load between the heating fixing roller 101 and pressing roller 102 is about 100 kgf, and the nip width is about 7 to 8 mm. By driving the heating fixing roller 101, the transfer sheet P conveying speed is so controlled as to be a specified speed, and in this invention paper is fed at three different levels of speed of 73 mm/sec, 110 mm/sec and 220 mm/sec. A halogen heater 161 is installed and fixed inside the aluminum cylindrical core of the heating fixing roller 101, and controlled ON/OFF by temperature sensors (not shown) installed at a position close to the heating fixing roller 101 surface and pressing roller 102 surface so that the surface temperature of the heating fixing roller 101 is kept at a specified value within a range from 160 to 210° C. and that the surface temperature of the pressing roller 102 is kept at a specified value within a range from 140 to 190° C.

Each cleaning roller A1, A2, A3, A4, A5, A6 and A7 used as the cleaning roller 103 of the fixing device 10 shown in Table 1 is as follows:

A1: It is a cleaning roller made of a cylindrical core of aluminum A5052 of 1.0 mm thick on which alumina film of about 40 μm thick is formed by hard anodizing, which is then subjected to secondary electrolysis in ammonium tetrathiomolybdate solution so as to deposit molybdenum disulfide in fine pores in the film, and finally the surface is polished by about 10 μm. The surface roughness Rz of the contact area to the heating fixing roller 101 is 3.2 μm and Vickers surface hardness is 360 kg/mm$^2$. The outside diameter is made to 24 mm.

A2: It is a cleaning roller made of a cylindrical core of aluminum pipe on which polyimide varnish is applied in not more than 10 μm thick after surface polishing and then baked. The surface roughness Rz of the contacting area to the heating fixing roller 101 is made to 3.2 μm and the outside diameter is made to 24 mm.

A3: It is a cleaning roller made of a cylindrical core of aluminum pipe which is covered with a foamed silicone rubber layer molded to Asker-C (500 gf load) hardness of 15 to 50°, which is then covered with PFA tube of 50 μm thick having the surface roughness Rz of 1.5 μm with an adhesion layer between them. The outside diameter is made to 24 mm.

A4: The same material as for the cleaning roller A1 is used but the surface polishing condition is changed so that the surface roughness Rz of the contact area to the heating fixing roller 101 is made to 1.5 μm and Vickers surface hardness to 360 kg/mm$^2$.

A5: The same cylindrical core as for the cleaning roller A3 is used but the surface polishing condition is changed to have smoother surface than the core of A2, on which polyimide varnish is applied in not more than 10 μm thick and then baked so that the surface roughness Rz of the contact area to the heating fixing roller 101 is made to 1.5 μm. The outside diameter is made to 24 mm.

A6: The same material as for the cleaning roller A1 is used but the surface polishing condition is changed so that the surface roughness Rz of the contact area to the heating fixing roller 101 is made to 0.8 μm and Vickers surface hardness to 360 kg/mm$^2$.

A7: It is a cleaning roller made of a cylindrical core of aluminum pipe having an outside diameter of 14 mm which is covered with a foamed silicone rubber layer of about 5 mm thick molded to Asker-C (500 gf load) hardness of 15 to 50° and of which surface is polished, which is then covered with insulating polyimide seamless tube of 80 μm thick with an adhesion layer between them. The surface roughness Rz is made to 0.8 μm and the outside diameter is made to 24 mm.

Each cleaning roller A1, A2, A3, A4, A5, A6 and A7 is contacted with pressure to the heating fixing roller 101 at a load of 8 kgf for image forming. It has been confirmed that the result would not change even if the contract pressure is changed to a load of 2 kgf.

The surface roughness Rz is measured on each roller as it is by a surface roughness meter (Surfcorder SE-3300 manufactured by Kosaka Laboratories, Ltd.).

The contact angle A between the contact surface area of the cleaning roller and wax contained in the toner at 160° C., contact angle B between the contact surface area of the heating fixing roller 101 and wax contained in the toner at 160° C., temperature C at the contract area between the heating fixing roller 101 and cleaning roller, and temperature D at the contact area between the cleaning roller and cleaning web 104 are also shown in Table 1. The contact angles A and B are also measured in a range from the melting point of the wax to 230° C., the maximum operating temperature of the heating fixing roller 101, but the inequality between the contact angles A and B does not change.

In order to measure the contact angles A and B, a small sample piece including each contact area of the heating fixing roller 101 and cleaning roller 103 is cut out and measured by liquid droplet method on Model CA-W150 manufactured by Kyowa Interface Science Co., Ltd. wherein the volume of droplet is set nearly constant. In order to heat the wax and object to be tested, a constant temperature bath Type H2 manufactured by Kyowa Interface Science Co., Ltd. is employed.

TABLE 1

| Image sample No. | Cleaning roller of fixing device 10 No. | Surface roughness Rz (μm) | A (°) | B (°) | C (°) | D (°) | Gloss memory |
|---|---|---|---|---|---|---|---|
| 1 | A1 | 3.2 | 35 | 63 | 160 | 110 | 1 |
| 2 | A2 | 3.2 | 22 | | to | to | 1 |
| 3 | A3 | 1.5 | 64 | | 190 | 140 | 2 |
| 4 | A4 | 1.5 | 35 | | | | 3 |
| 5 | A5 | 1.5 | 22 | | | | 3 |
| 6 | A6 | 0.8 | 22 | | | | 4 |
| 7 | A7 | 0.8 | 22 | | | | 4 |

[Evaluation of Gloss Memory on Image Samples 1 to 7]

The gloss memory on each of the prepared image samples 1 to 7 is evaluated according to the following criteria. The result is as shown in Table 1.

Level 1: Gloss memory is remarkably caused on every sample.

Level 2: Slight gloss memory is caused on every sample.

Level 3: Gloss memory is caused a little on some of the samples. The level of the gloss memory caused is similar to Level 2.

Level 4: Gloss memory is not caused on any sample.

From the result above, it is found that generation of gloss memory is prevented on the image samples fixed by the image forming device of the present invention. That is to say, the present invention not only eliminates generation of offset and paper winding but also prevents generation of gloss memory, and thus an image forming apparatus and fixing device that realizes high image quality can be offered.

What is claimed is:

1. An image forming apparatus having a fixing device for fixing toner including wax on a transfer sheet comprising:

a fixing rotating member for fixing toner on the transfer sheet with a rotation thereof, and a first cleaning member contacting to said fixing rotating member so as to remove melted wax on said fixing rotating member; and a second cleaning member that contacts to said first cleaning member so as to remove wax on the first cleaning member.

2. An image forming apparatus having a fixing device for fixing toner including wax on a transfer sheet comprising:

fixing rotating member for fixing toner on the transfer sheet with a rotation thereof, and first cleaning member contacting to said fixing rotating member so as to remove melted wax on said fixing rotating member, said fixing rotating member having a heater, wherein a surface roughness Rz of said first cleaning member is not more than 1.6 μm; further comprising second cleaning member that contacts to first cleaning member so as to remove wax on the first cleaning member.

3. An image forming apparatus as set forth in claim 2, wherein said first cleaning member is rotating member and said second cleaning member is cleaning member in sheet form, comprising moving means for moving the second cleaning member towards said first cleaning member.

4. An image forming apparatus as set forth in claim 2, wherein said second cleaning member is not soaked with silicone oil.

5. An image forming apparatus as set forth in claim 2, wherein the second cleaning member is non-woven fabric containing at least one of aromatic polyamide fiber and polyester fiber.

6. An image forming apparatus as set forth in claim 2, wherein the contact portion between said first cleaning member and said fixing rotating member and the contact portion between said first cleaning member and the second cleaning member are not less than the maximum sheet width of transfer material.

7. An image forming apparatus having a fixing device for fixing toner including wax on a transfer sheet comprising:

fixing rotating member for fixing toner on the transfer sheet with a rotation thereof, and first cleaning member contacting to said fixing rotating member so as to remove melted wax on said fixing rotating member, said fixing rotating member having a heater, wherein a surface roughness Rz of said first cleaning member is not more than 1.6 μm; and wherein said first cleaning member is equipped with heater.

8. An image forming apparatus having a fixing device for fixing toner including wax on a transfer sheet comprising:

fixing rotating member for fixing toner on the transfer sheet with a rotation thereof, and first cleaning member contacting to said fixing rotating member so as to remove melted wax on said fixing rotating member, said fixing rotating member having a heater, wherein a surface roughness Rz of said first cleaning member is not more than 1.6 μm; and wherein, given that the contact angle of said first cleaning member surface with regard to the melted wax is A (°) and that the contact angle of said fixing rotating member surface with regard to the melted wax is B (°), A<B applies.

9. An image forming apparatus having a fixing device for fixing toner including wax on a transfer sheet comprising:

fixing rotating member for fixing toner on the transfer sheet with a rotation thereof, and first cleaning member contacting to said fixing rotating member so as to remove melted wax on said fixing rotating member, said fixing rotating member having a heater, wherein a surface roughness Rz of said first cleaning member is not more than 1.6 μm; and wherein said fixing rotating member has a heat-resisting elastic layer of not less than 0.2 mm, and said first cleaning member, of which Vickers surface hardness is not less than 350 kg/mm$^2$, pressure-contacts to said fixing rotating member at a load of 2 to 10 kgf.

10. A fixing device for fixing toner including wax on a transfer sheet comprising:

fixing rotating member for fixing toner on the transfer sheet with a rotation thereof, and first cleaning member contacting to said fixing rotating member for removing melted wax on said fixing rotating member, said fixing rotating member having a heater, wherein a surface roughness Rz of said first cleaning member is not more than 1.6 μm; further comprising second cleaning member that contacts to first cleaning member so as to remove wax on the first cleaning member.

11. A fixing device as set forth in claim 10, wherein said second cleaning member is not soaked with silicone oil.

12. A fixing device for fixing toner including wax on a transfer sheet comprising:

fixing rotating member for fixing toner on the transfer sheet with a rotation thereof, and first cleaning member contacting to said fixing rotating member for removing melted wax on said fixing rotating member, said fixing rotating member having a heater, wherein a surface roughness Rz of said first cleaning member is not more than 1.6 μm; and wherein said first cleaning member is equipped with heater.

13. A fixing device for fixing toner including wax on a transfer sheet comprising:

fixing rotating member for fixing toner on the transfer sheet with a rotation thereof, and first cleaning member contacting to said fixing rotating member for removing melted wax on said fixing rotating member, said fixing rotating member having a heater, wherein a surface roughness Rz of said first cleaning member is not more than 1.6 μm; and wherein, given that the contact angle of said first cleaning member surface with regard to the melted wax is A (°) and that the contact angle of said fixing rotating member surface with regard to the melted wax is B (°), A<B applies.

14. A fixing device for fixing toner including wax on a transfer sheet comprising:

fixing rotating member for fixing toner on the transfer sheet with a rotation thereof, and first cleaning member contacting to said fixing rotating member for removing melted wax on said fixing rotating member, said fixing rotating member having a heater, wherein a surface roughness Rz of said first cleaning member is not more than 1.6 μm; and wherein said fixing rotating member has a heat-resisting elastic layer of not less than 0.2 mm, and said first cleaning member, of which Vickers surface hardness is not less than 350 kg/mm$^2$, pressure-contacts to said fixing rotating member at a load of 2 to 10 kgf.

* * * * *